US008044592B2

(12) United States Patent
Chou

(10) Patent No.: US 8,044,592 B2
(45) Date of Patent: Oct. 25, 2011

(54) LAMP HEAT DISSIPATING STRUCTURE

(76) Inventor: Tony Chou, Taipei County (TW)

( * ) Notice: Subject to any disclaimer, the term of this patent is extended or adjusted under 35 U.S.C. 154(b) by 0 days.

(21) Appl. No.: 12/854,704

(22) Filed: Aug. 11, 2010

(65) Prior Publication Data

US 2010/0320911 A1 Dec. 23, 2010

Related U.S. Application Data

(63) Continuation-in-part of application No. 12/125,194, filed on May 22, 2008, now abandoned.

(51) Int. Cl.
*H01J 7/44* (2006.01)

(52) U.S. Cl. ..... 315/70; 362/249.02; 362/800; 362/640; 362/294

(58) Field of Classification Search ..... 362/800, 362/249, 373, 294, 640–659; 315/70
See application file for complete search history.

(56) References Cited

U.S. PATENT DOCUMENTS

| | | | | |
|---|---|---|---|---|
| 4,497,016 | A * | 1/1985 | Sachse | 362/294 |
| 7,293,897 | B2 | 11/2007 | Mendelsohn | |
| 7,419,281 | B2 | 9/2008 | Porchia et al. | |
| 7,646,279 | B2 * | 1/2010 | Limpkin et al. | 336/131 |

FOREIGN PATENT DOCUMENTS

| | | |
|---|---|---|
| TW | M265535 | 5/2005 |
| TW | M272222 | 8/2005 |
| TW | M275529 | 9/2005 |
| TW | M305303 | 1/2007 |

* cited by examiner

*Primary Examiner* — Anabel Ton
(74) *Attorney, Agent, or Firm* — Muncy, Geissler, Olds & Lowe, PLLC

(57) ABSTRACT

A heat dissipating structure for a lamp includes at least an illuminating element, a lamp base, a metal housing, a ring-shaped coil and a metal base. The metal housing has a great heat conducting capability, and the illuminating element is mounted on the lamp base, which is engaged with the metal housing. The ring-shaped coil which includes a primary winding and a secondary winding wound on a ring iron core is mounted between the metal housing and lamp base, wherein the ring iron core further includes an inner space for accommodating plural electronic components connected with the secondary winding, and the ring-shaped coil is electrically connected with the illuminating element and metal base. And, the metal base is electrically connected to a power source, so that through a conduction of the metal base, the ring-shaped coil can acquire and transform electricity to provide to the illuminating element for operation.

10 Claims, 6 Drawing Sheets

LAMP HEAT DISSIPATING STRUCTURE

This application is a continuation-in-part, and claims priority, of from U.S. patent application Ser. No. 12/125,194 filed on May 22, 2008, entitled "LAMP HEAT DISSIPATING STRUCTURE", the entire contents of which are hereby incorporated by reference.

FIELD OF THE INVENTION

The present invention is related to a heat dissipating structure for a lamp, and more particularly to a heat dissipating structure for a lamp base, so as to provide a heat dissipating function therefor.

BACKGROUND OF THE INVENTION

Currently, the main illumination instruments are still incandescent lamps (and also the energy saver fluorescent lamps) since most families, offices and public places still employ the base structure for the incandescent lamps, and also the newly developed LED illuminations are still not popular. A conventional lamp is illustrated in R.O.C. Patent No. M305303, entitled "Structure improvement of fluorescent bulb", whose abstract disclosed that "The present application is related to an improved fluorescent bulb structure so as to provide a more practical efficacy, including two light permeable half plastic housings, a fluorescent tube, a positioning base, an auxiliary sleeve, a circuit board; and a conducting head, wherein the circuit board is fixedly mounted on the positioning base and the auxiliary sleeve in advance, and then assembled within the conducting head and the housings for reducing the total volume, and also, the plastic housings which are not easily broken can improve the usage safety." The fluorescent bulb is composed of a lamp housing, a positioning base, a fluorescent tube, a conducting head, a circuit board, and electronic components connected to the circuit board, wherein the lamp housing is consisted of the two light permeable half plastic housings, and the two light permeable half housings have plural heat dissipating holes mounted thereon for providing heat dissipating function. However, since the fluorescent tube is encapsulated in the lamp housing and the positioning base does not additionally provide the heat dissipating function, the exhausting of the heat produced by the fluorescent tube through the heat dissipating holes has to be achieved by air convection. But, based on the physical principle that hot air rises up, it is obvious the heat dissipating holes which are located at the lower portion of the lamp housing can not efficiently exhaust the heat. Besides, the encapsulated structure also lowers down the heat dissipating efficiency. Therefore, this is still improvable. Another disclosure, R.O.C. Patent No. M265535, entitled "Bulb Type of Daylight Lamp Composite Structure", has the abstract described that "The present application is related to the structure of a daylight fluorescent bulb which provides an easier and rapider assembling manner for the daylight fluorescent tube, the housing and the metal head, and also achieves the efficacies of firmness and durability, including an integrally formed assembling/fixing component having threads, a plate, engaging pieces, and engaging openings, wherein through the threads, the engaging pieces, and the engaging openings, the daylight fluorescent tube can be rapidly and securely assembled without adhesives, and through the threads and the plate, the housing and the metal head can be screwed and positioned rapidly and firmly, thereby improving the efficacy and providing a great practicability." The bulb lamp includes a daylight fluorescent tube, a metal head, an outer shell, an assembling/fixing component, and a ballast and starter. In this disclosure, although the daylight fluorescent tube is not sealed for providing a better heat dissipating effect, the ballast and starter is accommodated in the assembling/fixing component, which only provides several let-in holes for passing through the air and providing slight heat dissipating effect. Thus, the daylight fluorescent tube still might become overheated. Consequently, although the above-described applications do achieve the main objects thereof, the heat dissipating efficiency is still improvable for preventing the overheated situation from reducing the life of the lamp.

SUMMARY OF THE INVENTION

The object of the present invention is to provide a lamp structure with great heat dissipating capability, so as to increase the life time of the lamp.

The present invention is related to a heat dissipating structure for a lamp including an illuminating element, a lamp base, a metal housing, a ring-shaped coil and a metal base. The metal housing has a great heat conducting capability, and the illuminating element is mounted on the lamp base, which is engaged with the metal housing. The ring-shaped coil which includes a primary winding and a secondary winding wound on a ring iron core is mounted between the metal housing and the lamp base, wherein the ring iron core further includes an inner space for accommodating plural electronic components connected with the secondary winding, and the ring-shaped coil is electrically connected with the illuminating element and the metal base. And, the metal base is electrically connected to a power source, so that through a conduction of the metal base, the ring-shaped coil can acquire and transform electricity to provide to the illuminating element for operation.

Therefore, through the great heat conductivity of the metal housing, the heat can be averagely distributed over the surface thereof for emitting outwardly so as to reduce the lamp temperature during operation and extend the life time of lamp.

BRIEF DESCRIPTION OF THE DRAWINGS

The foregoing aspects and many of the attendant advantages of the present invention will be more readily appreciated as the same becomes better understood by reference to the following detailed description, when taken in conjunction with the accompanying drawings, wherein.

DESCRIPTION OF THE PREFERRED EMBODIMENT

Figure 1:
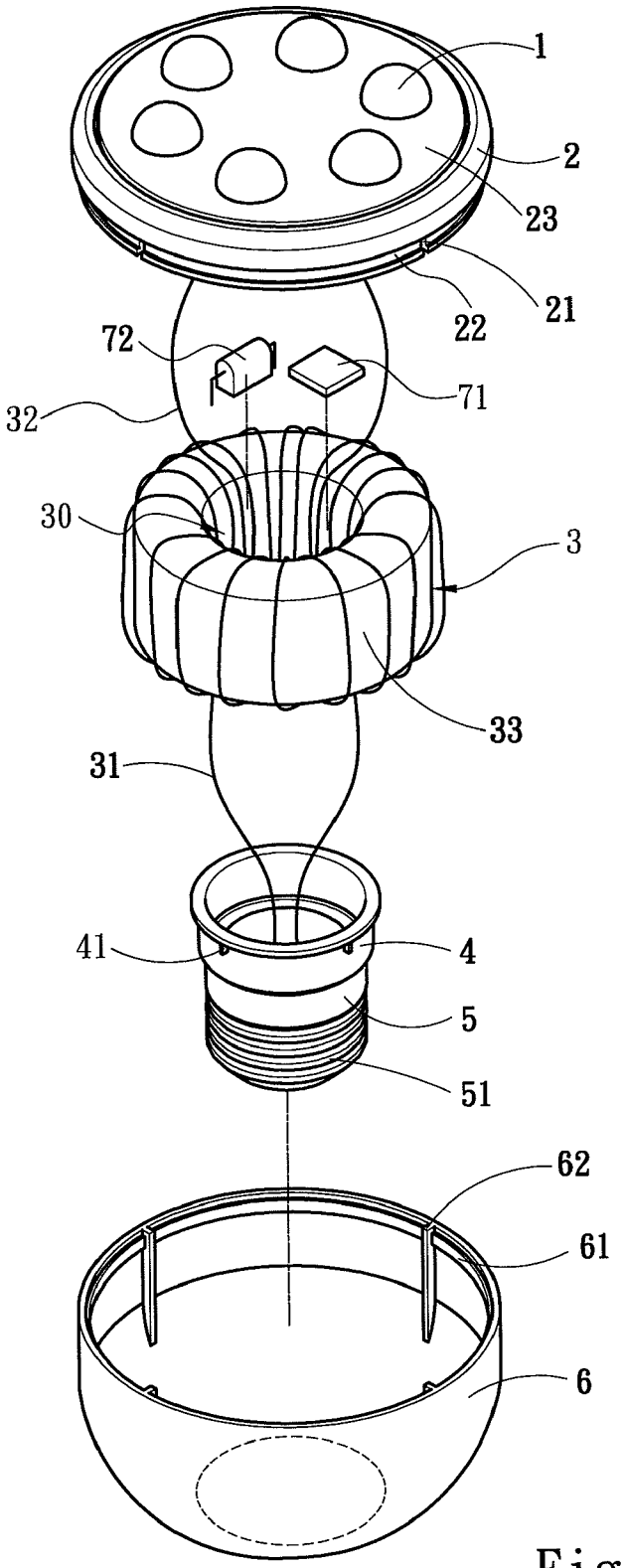
FIG. 1 is a decomposition drawing of the present invention.
Figure 2:
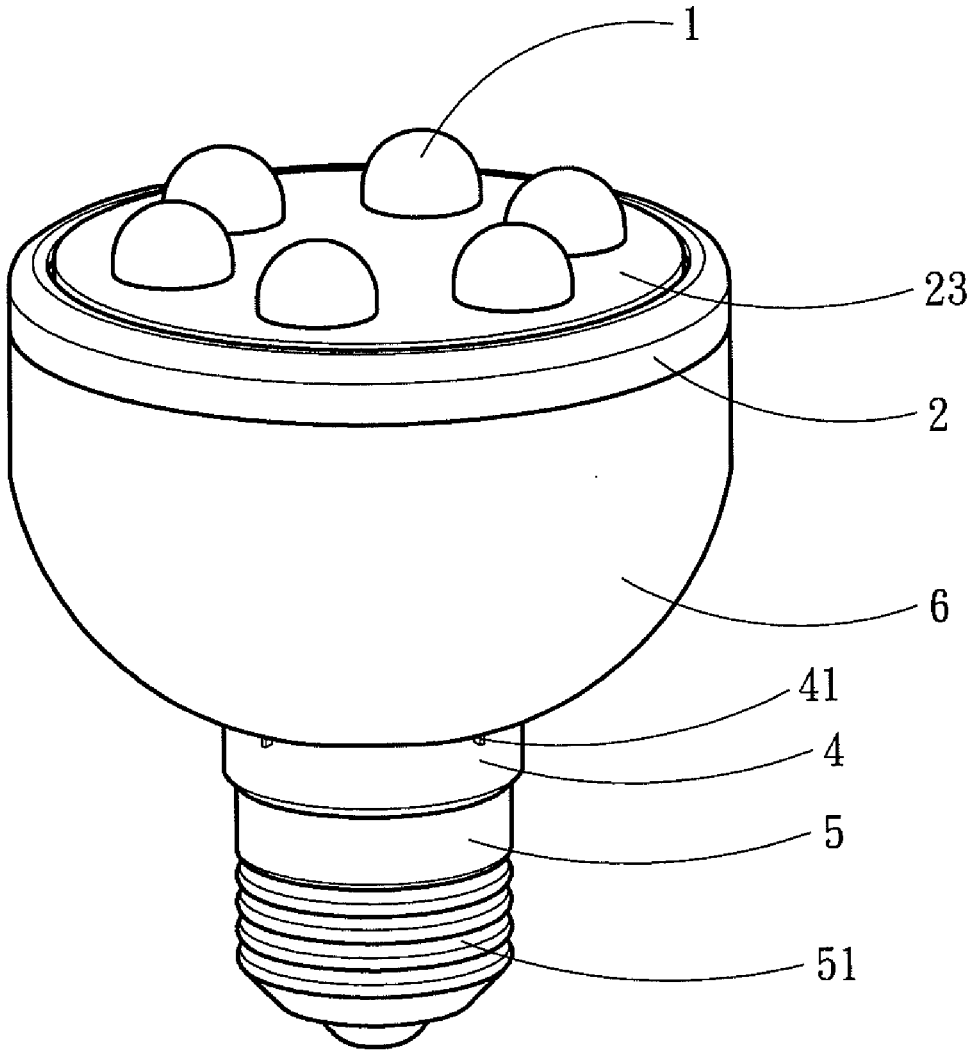
FIG. 2 is a three-dimensional drawing of the present invention.
Figure 3A:
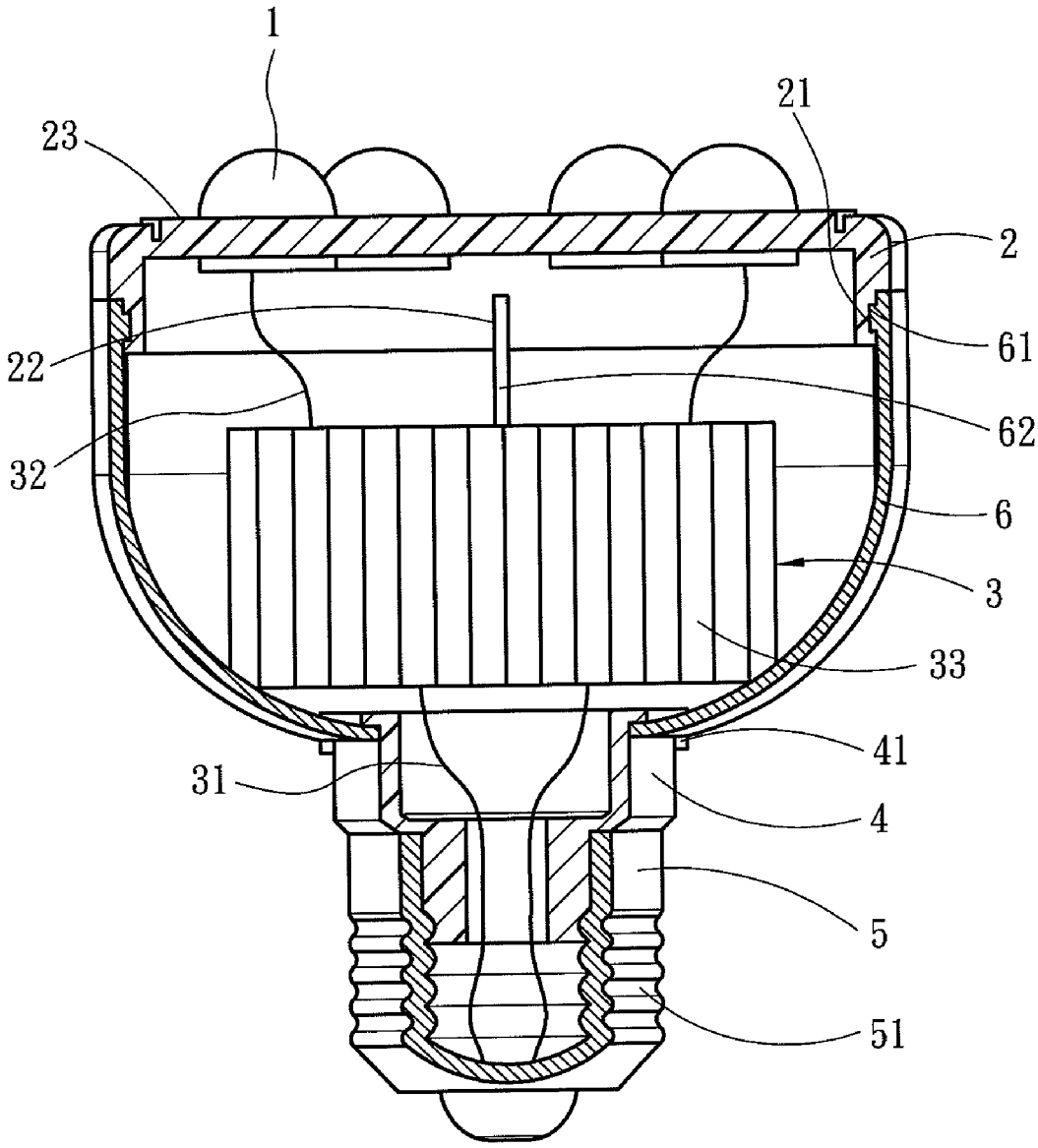
FIG. 3A is a sectional view of the present invention.
Figure 3B:
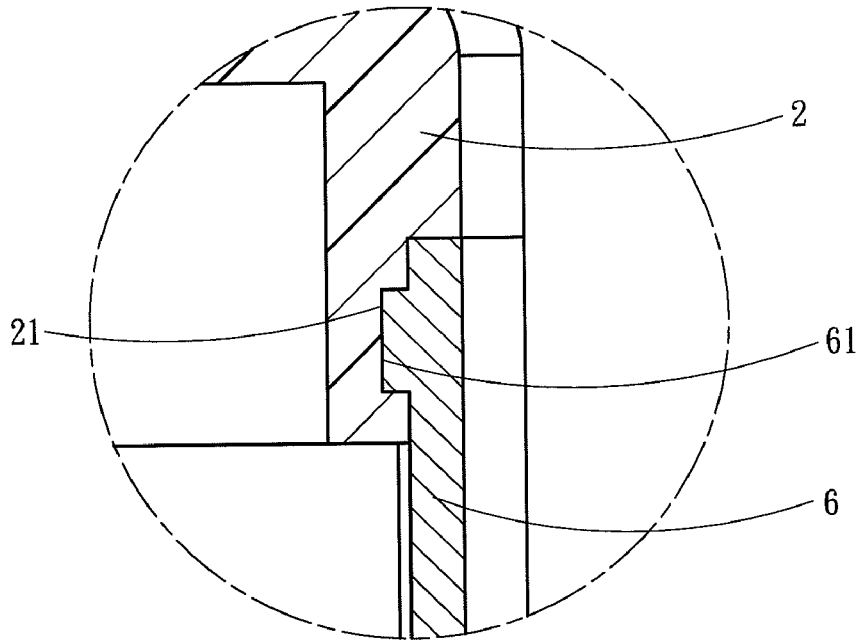
FIG. 3B is a partially magnified sectional view of the present invention.
Figure 4:
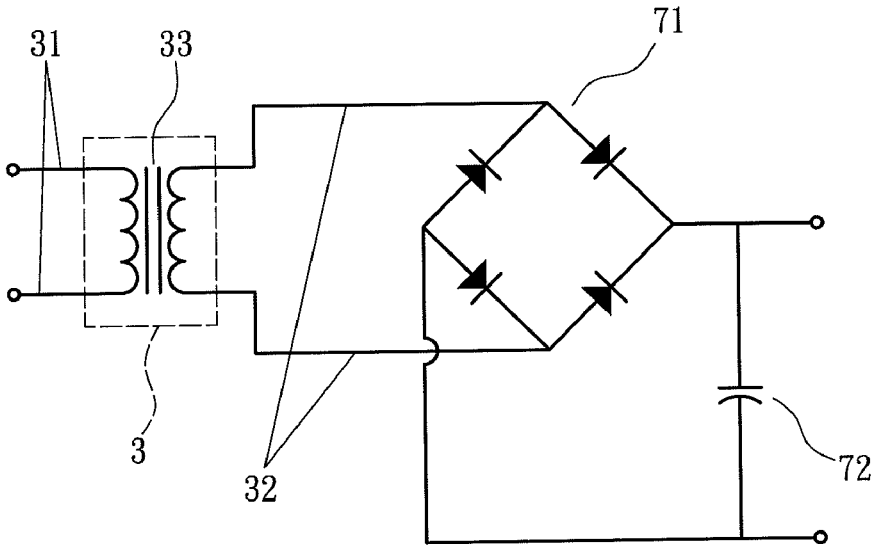
FIG. 4 is a schematic view showing an equivalent circuit of a ring-shaped coil, a rectifying component and a filtering component.
Figure 5:
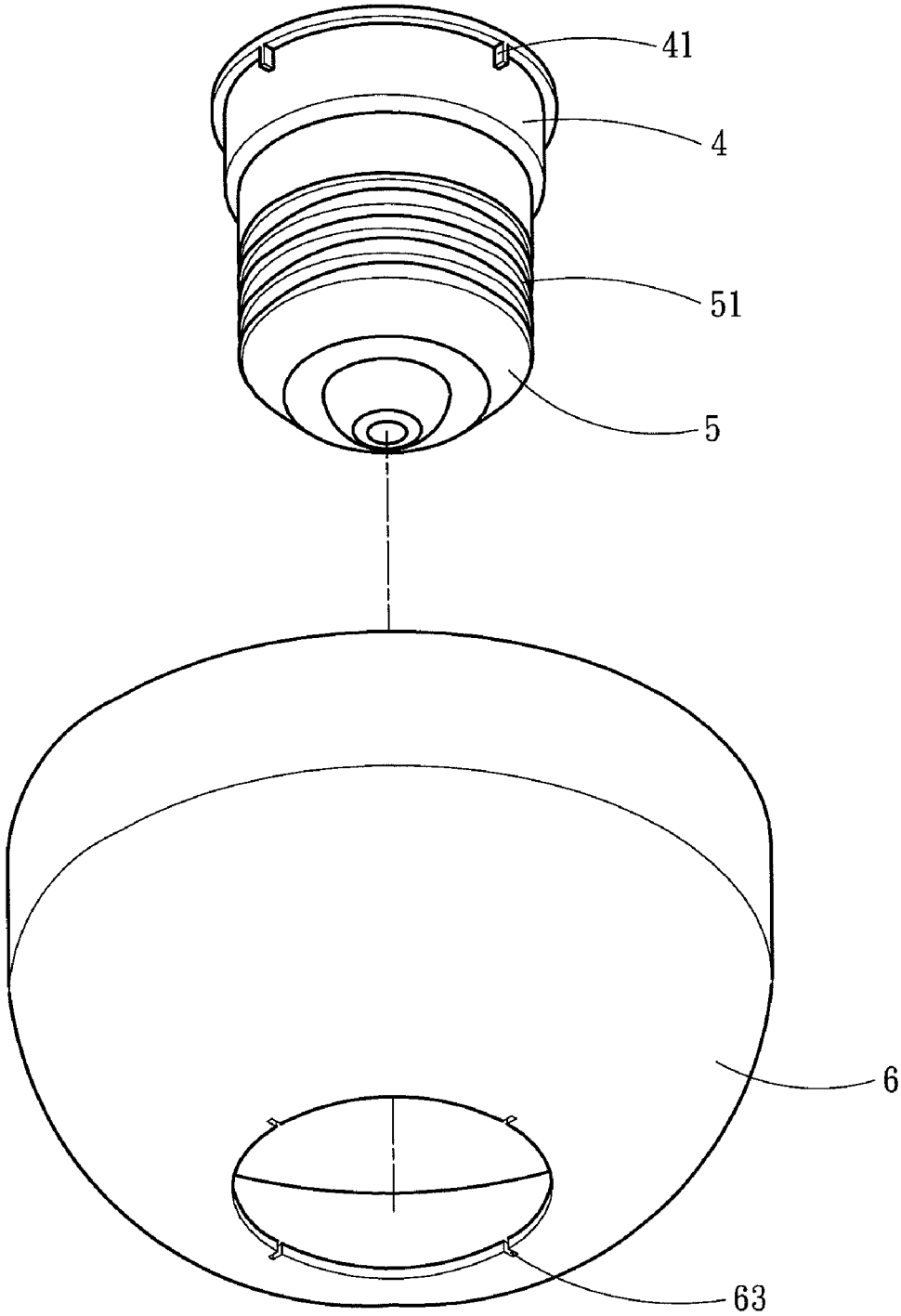
FIG. 5 is a schematic view showing the assembling between a connecting element and a metal housing.

Please refer to FIG. 1, FIG. 2, FIG. 3A, FIG. 3B, FIG. 4 and FIG. 5. A lamp of the present invention includes an illuminating element 1, a lamp base 2, a metal housing 6, a ring-shaped coil 3 and a metal base 5. The metal housing 6 has a great heat conducting capability and includes two opposite openings, wherein one smaller opening is provided for passing therethrough the metal base 5. Between the metal base 5 and the metal housing 6, a connecting element 4 is further provided for insulation and protection, wherein two ends of the connecting element 4 are respectively adhered to or screwed on the metal base 5 and the metal housing 6, and a male engaging portion 41 is provided on the connecting element 4 for engaging with a female engaging portion 63, which is mounted on the metal housing 6 at a corresponding position thereto, so as to assemble the connecting element 4 and the metal housing 6 together (as shown in FIG. 5). The ring-shaped coil 3 is mounted between the metal housing 6 and the lamp base 2 (as shown in FIG. 1 and FIG. 3A). The ring-shaped coil 3 is composed of a primary winding 31 and a secondary winding 32 wound on a ring iron core 33, wherein the ring iron core 33 has an inner space 30 for accommodating plural electronic components connected with the secondary winding 32. In a preferred embodiment, the plural electronic components can be a rectifying component 71 and a filtering component, and preferably, the filtering component can be a capacitor 72, so as to form an equivalent circuit as shown in FIG. 4 for driving the illuminating element 1. Further, the secondary winding 32 is electrically connected with the illuminating element 1, and the primary winding 31 is electrically connected with the metal base 5.

The other larger opening of the metal housing 6 has at least a protruded ring 61 and at least a male engaging portion 62 mounted on the inner edge thereof, and the circumference of the lamp base 2 has an indent trough 21 and a female engaging portion 22 respectively corresponding thereto. Therefore, through the engagements between the indent trough 21 and the protruded ring 61 and between the female engaging portion 22 and the male engaging portion 62, the lamp base 2 can be assembled onto the larger opening of the metal housing 6 (as shown in FIG. 3B), so as to form an encapsulated structure. The illuminating element 1 is assembled on a bearing surface 23 of the lamp base 2 so as to form an integral lamp assembly (as shown in FIG. 2). The illuminating element 1 is electrically connected to the secondary winding 32 of the ring-shaped coil 3, and the primary winding 31 is electrically connected to the metal base 5. The metal base 5 has threads 51 mounted thereon. After the metal base 5 is contacted with the power source and conducted thereby, through the ring-shaped coil 3, the rectifying component 71, and the capacitor 72, the electricity can be transformed and transmitted to the illuminating element 1 (as shown in FIG. 1, which can be plural LEDs) for illumination. Furthermore, the male engaging portions 62, 41 can have a slat-like shape and the female engaging portions 22, 63 can be slots perfectly matched therewith, so that the heat produced from the illuminating element 1, the ring-shaped coil 3, the rectifying component 71 and the capacitor 72 can be conducted to the metal housing 6, which is preferably made of aluminum alloy or copper alloy. Therefore, through the great heat conductivity of the metal housing 6, the heat from the illuminating element 1 and the ring-shaped coil 3 can be averagely distributed over the surface thereof for emitting outwardly so as to reduce the lamp temperature during operation.

Figure 6:
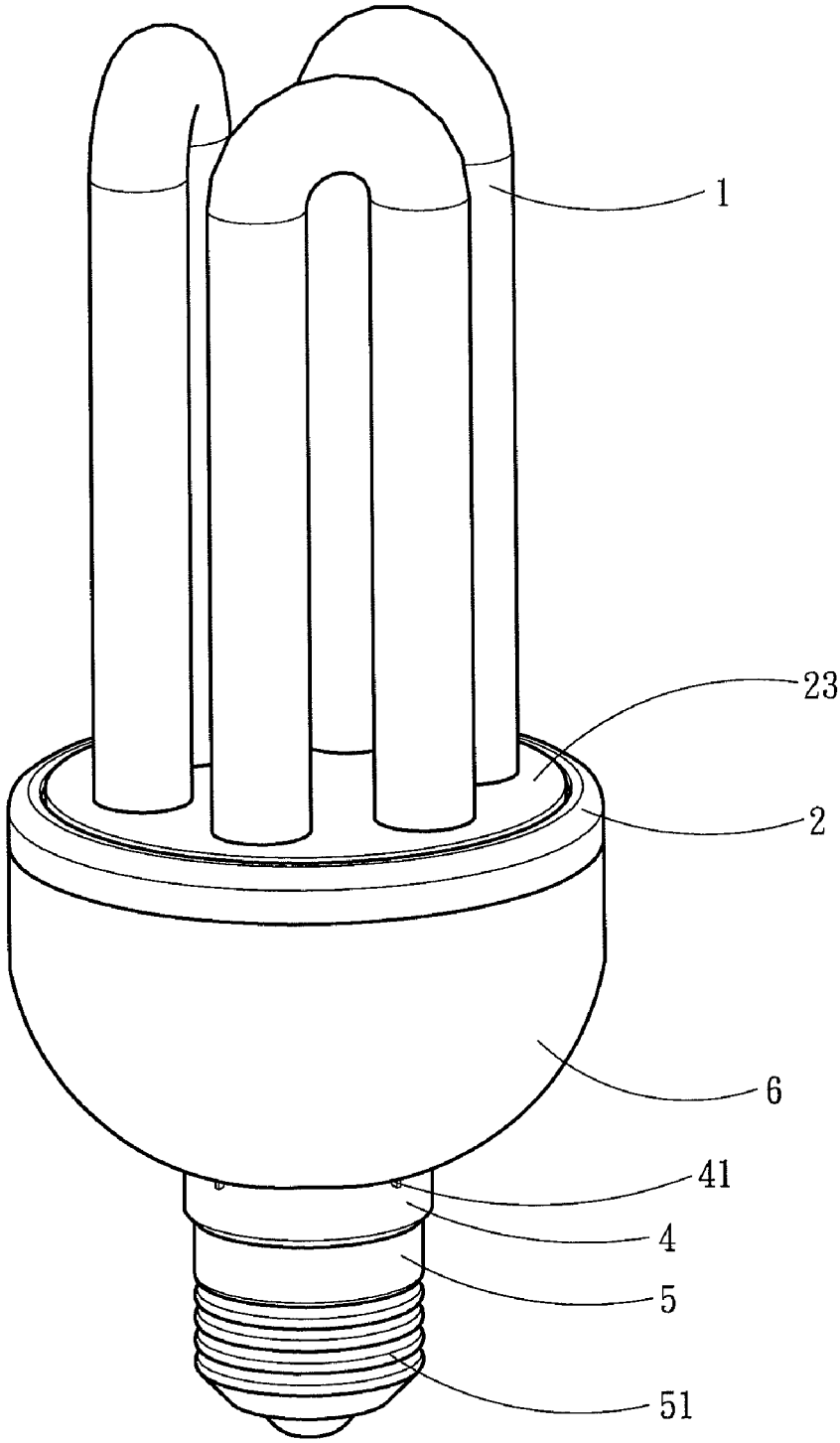
FIG. 6 is a three-dimensional drawing of another embodiment of the present invention.

Please refer to FIG. 6, as shown, the illuminating element 1 is not restricted to be LEDs, and it also can be a bulb. Besides, the ring-shaped coil 3 also can be connected with other electronic components, such as plural resistors, inducers, and ICs. By utilizing the ring-shaped coil 3 to replace the conventional electronic rectifier, in addition to providing more stable DC electricity, the problems of high frequency harmonic pollution, EMI, and oversized volume (which causes the difficulty in installing in a small lamp) also can be solved. Therefore, the ring-shaped coil 3 not only can be suitable for lamps of various sizes, but also possesses the advantages of reduced harmonic, noises and EMI.

It is to be understood, however, that even though numerous characteristics and advantages of the present invention have been set forth in the foregoing description, together with details of the structure and function of the present invention, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A heat dissipating structure for a lamp, comprising:

at least an illuminating element mounted on a lamp base, which is engaged with a metal housing of great heat conducting capability, wherein between the metal housing and the lamp base, a ring-shaped coil comprising a primary winding and a secondary winding wound on a ring iron core is mounted, the ring iron core comprises an inner space for accommodating plural electronic components connected with the secondary winding, the secondary winding of the ring-shaped coil is electrically connected with the illuminating element and the primary winding of the ring-shaped coil is electrically connected with a metal base, and the metal base is electrically connected to a power source, so that through a conduction of the metal base, the primary winding of the ring-shaped coil acquires an input electricity and the secondary winding of the ring-shaped coil provides a DC electricity to the illuminating element for operation.

2. The heat dissipating structure as claimed in claim 1, wherein the illuminating element is a lamp bulb.

3. The heat dissipating structure as claimed in claim 1, wherein the illuminating element is a LED.

4. The heat dissipating structure as claimed in claim 1, wherein a connecting element is further provided whose two ends are respectively connected to the metal housing and the metal base.

5. The heat dissipating structure as claimed in claim 4, wherein the connecting element has a male engaging portion and the metal housing has a corresponding female engaging portion.

6. The heat dissipating structure as claimed in claim 5, wherein the male engaging portion has a slat-like shape and the female engaging portion is a slot perfectly matched therewith.

7. The heat dissipating structure as claimed in claim 1, wherein the metal housing and the lamp base respectively have a male engaging portion and a female engaging portion for engaging with each other, so as to assemble the lamp base and the metal housing together.

8. The heat dissipating structure as claimed in claim 7, wherein the male engaging portion has a slat-like shape and the female engaging portion is a slot perfectly matched therewith.

9. The heat dissipating structure as claimed in claim 1, wherein the electronic components accommodated in the inner space of the ring-shaped coil comprise a rectifying component and a filtering component.

10. The heat dissipating structure as claimed in claim 9, wherein the filtering component is a capacitor.

* * * * *